United States Patent [19]

Livera

[11] Patent Number: 5,045,756

[45] Date of Patent: Sep. 3, 1991

[54] NON-CONDUCTIVE COLLAR FOR THE CONDUCTIVE SHELL OF AN ELECTRICAL DISCHARGE DEVICE

[75] Inventor: Phillip A. Livera, East Hanover, N.J.

[73] Assignee: E.G.L. Corporation, Inc., Newark, N.J.

[21] Appl. No.: 638,194

[22] Filed: Jan. 2, 1991

[51] Int. Cl.[5] ..... H01J 61/06

[52] U.S. Cl. ..... 313/631; 313/618; 313/356

[58] Field of Search ..... 313/631, 632, 618, 339, 313/356, 615, 356, 231.71, 231.41, 609, 611, 325, 619

[56] References Cited

U.S. PATENT DOCUMENTS

| | | | |
|---|---|---|---|
| 1,949,276 | 2/1934 | Huffman | 313/618 |
| 1,984,482 | 12/1934 | Imamura | 313/618 |
| 2,243,496 | 5/1941 | Boore | 313/356 |
| 2,271,658 | 2/1942 | Miller | 313/325 |
| 2,443,632 | 6/1948 | Miller | 313/356 |
| 3,369,143 | 2/1968 | Gilmore et al. | 313/331 |
| 3,636,401 | 1/1972 | Cortorillo et al. | 313/631 |
| 4,065,691 | 12/1977 | McVey | 313/625 |
| 4,092,560 | 5/1978 | Puskas | 313/326 |
| 4,611,145 | 9/1986 | Kamul et al. | 313/337 |
| 4,825,126 | 4/1989 | Izuniya et al. | 313/332 |

FOREIGN PATENT DOCUMENTS

| | | | |
|---|---|---|---|
| 0212392 | 12/1955 | Australia | 313/339 |
| 1026193 | 6/1983 | U.S.S.R. . | |
| 1472972 | 4/1989 | U.S.S.R. . | |

*Primary Examiner*—Donald J. Yusko
*Assistant Examiner*—Nimeshkumar Patel
*Attorney, Agent, or Firm*—Thomas L. Adams

[57] ABSTRACT

An electric discharge device has a conductive shell mounted in a non-conductive tube. A non-conductive collar can mount in the conductive shell. The collar includes an annular neck and an annular flange. The neck is encircled by a central annular groove located between a spaced pair of circumferential plateaus. The plateaus are radially dimensioned to fit in the conductive shell. The annular flange is coaxially affixed to and radially larger than the annular neck.

14 Claims, 1 Drawing Sheet

PRIOR ART

NON-CONDUCTIVE COLLAR FOR THE CONDUCTIVE SHELL OF AN ELECTRICAL DISCHARGE DEVICE

BACKGROUND OF THE INVENTION

The present invention relates to electric discharge devices and, in particular, to a non-conductive collar for mounting in a conductive shell in a non-conductive tube.

Various lighting devices such as neon lights employ an electrode that is mounted within a hermetically sealed tube containing a rare gas. A known electrode includes a cylindrical metallic shell mounted on leads that support the shell coaxially in a glass tube. The metallic shell is internally coated with an electron emissive material.

In the manufacture of quality electrodes, a ceramic collar (made for example from STEATITE L4 or L5) is inserted into the open end of the metal shell that acts as an electron emitting source. The collar is attached during a shell rolling step where the shell is crimped into an annular dovetail recess on the collar.

The purpose of the collar during normal lamp use is to collimate the arc stream generated inside the shell and to restrict the flow of electrons that tend to blacken the fringe areas of the phosphor coated neon tube. By collimating the electron beam, the collar increases the efficiency of the operation. The collar also prevents the sputtering that might otherwise occur on the conductive shell. The sputtering erodes the electrode as well as blackening the inside of the glass tube in which the tube is mounted. This blackening is aesthetically undesirable and can degrade performance. The flange of the collar can also prevent electrons flowing through the collar from returning to the outside of the shell.

The collar acts to collimate the arc stream and gives rise to uniform heating of the shell during a bombardment cycle when large currents are applied during lamp manufacture. One conspicuous problem with the collar, however, is the arcing and blackening that takes place during said bombardment. A tight seal between the shell and collar can reduce or eliminate this undesirable effect, but the tightness of the seal between the shell and collar is limited by the compressive strength of the ceramic.

FIG. 3 shows a technique according to the prior art for sealing a shell 14 and collar 42. The dovetail locking area denoted by 44 is considered conventional with the lip of the shell 14 remaining open at about its original diameter. In these prior designs the force used during the shell sealing operation is limited by the compressive strength of the collar. Cracking can occur when attempting to achieve a good metal to ceramic seal.

In U.S. Pat. No. 1,984,482 the metallic shell of the electrode is capped by a ceramic disc or cap. The device is held either by studs on the shell or by thermally crimping the glass tube containing the electrode. This reference does not show, however, a technique for achieving a tight shell to collar seal.

Russian references 1,472,972 and 1,026,193 both show cylindrical electrode shells holding at their outer ends an insulating bushing. These bushings have a hollow cylindrical neck and a flange of a greater diameter. The neck flares in a direction away from the flange. The flaring leaves a valley with a low point at the junction between the flange and the neck. The cylindrical electrode shell is crimped over the neck and into the valley.

A disadvantage with this type of crimping is that the crimping forces are applied at the valley at a point where the material thickness is minimal. This crimping action either restricts the crimping force or tends to crack the bushing.

See also U.S. Pat. Nos. 1,949,276; 2,271,658; 3,369,143; 3,636,401; 4,065,691; 4,092,560; 4,611,145; and 4,825,126.

It is an object of this invention to allow the neck sealing operation to proceed with the force necessary to seal tightly these components. Thus, there is a need for an improved insulating collar that can be tightly crimp-mounted in an electrode shell without cracking.

SUMMARY OF THE INVENTION

In accordance with the illustrative embodiments demonstrating features and advantages of the present invention, there is provided a non-conductive collar in an electric discharge device having a conductive shell mounted in a non-conductive tube. The non-conductive collar can be mounted in the conductive shell. The collar includes an annular neck and an annular flange. The annular neck is encircled by a central annular groove located between a spaced pair of circumferential plateaus radially dimensioned to fit in the conductive shell. The annular flange is coaxially affixed to and radially larger than the annular neck.

In a related method of the same invention, the centrally grooved neck of a flanged non-conductive collar can be attached to a conductive shell arranged for mounting in a non-conductive tube. The method includes the step of inserting the neck of the collar into an end of the shell. Another step in the method is deforming the shell to descend into the groove of the collar to produce in the shell an annular depression. The connection between said shell and said collar is tightened to an extent to prevent arcing between said shell and said collar.

Collars of the forgoing type can be crimp-mounted in a cylindrical shell without cracking. In the preferred embodiment, the collar has a neck terminating in a flange. The neck has a groove that is centered on the neck, axially. The groove is preferably formed of a pair of frustro-conical banks. This preferred collar is easily mounted into a cylindrical shell by crimping the shell into the central groove. Because of the arrangement of the groove the collar is less likely to crack even if the shell is compressed tightly enough to prevent arcing between the collar and shell.

The preferred collar modifies collar 42 according to the prior art (FIG. 3) by utilizing the open area 46. A redesigned collar fills area 46 of the neck with the basic ceramic material. This thickening strengthens the collar by some 70%.

BRIEF DESCRIPTION OF THE DRAWINGS

The above brief description as well as other objects, features and advantages of the present invention will be more fully appreciated by reference to the following detailed description of presently preferred, but nonetheless illustrative embodiments in accordance with the present invention when taken in conjunction with the accompanying drawings wherein.

DETAILED DESCRIPTION OF THE PREFERRED EMBODIMENTS

Figure 1:
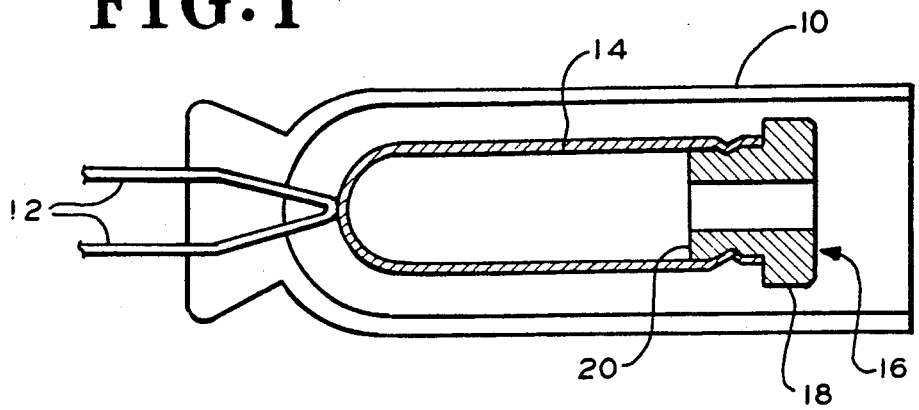
FIG. 1 is a side view, partially in section, of an electric discharge device having a non-conductive collar in accordance with the principles of the present invention.

Referring to FIG. 1, an electrode is shown comprising a glass tube 10, although other vitreous or non-conductive materials may be used instead of glass. The outer end of tube 10 is sealed around a pair of wire leads 12. Leads 12 converge together on the inside of tube 10 and are welded to a cup-shaped, metallic shell 14. Shell 14 can be formed of steel, iron or other appropriate conductive materials. The inside of shell 14 is coated with a material that easily emits electrons.

A non-conductive collar 16 is shown herein as a generally hollow, cylindrical, annular neck 20 terminating in a larger annular flange 18.

Figure 2:
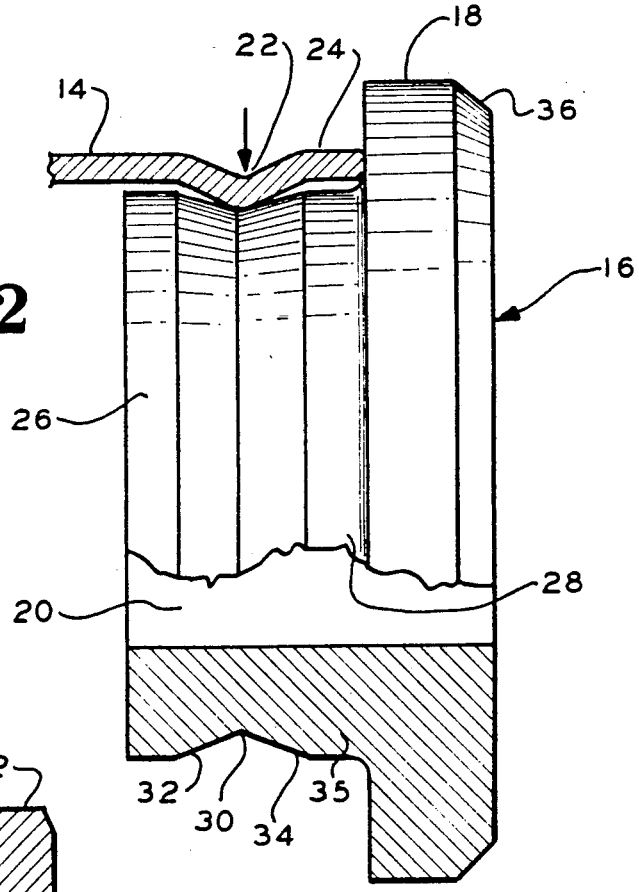
FIG. 2 is a detailed side view, partially in section, of the collar and shell of FIG. 1.

In FIG. 2, collar 16 is shown in further detail, with conductive shell 14 crimped so that an annular depression 22 is formed in the shell. The annular depression 22 terminates at section 24 having about the same diameter as before crimping. Neck 20 has a circumferential plateau 26 distal from flange 18 and another circumferential plateau 28 proximal to flange 18.

Between plateaus 26 and 28 is a central annular groove 30 which has a pair of contiguous, frustro-conical, banks 32 and 34. The junction between plateau 28 and flange 18 is a rounded inside corner. The outer corner 36 of flange 18 distal from neck 20 is chamfered for ease of assembly into the glass tube (shown in FIG. 1).

Collar 16 is a ceramic (STEATITE L4 or L5). The shape of collar 16 is established when the material is green, i.e. unsintered prior to firing. After being shaped, the collar 16 is fired to make the collar relatively rigid.

It is desirable to have the inside diameter large enough to facilitate an adequate current flow, but not so large that the thickness of the collar walls are reduced and breakage is more likely. Also, the outside diameter of flange 18 is chosen to bring its circumference close to the inside surface of glass tube 10 (FIG. 1). This reduces the area available for current flow backwards around the flange onto the outside of the electrode shell 14.

For example, the inside diameter of collar 16 can be nominally 0.205 inch. The outside diameter of flange 18 can be nominally 0.480 inch. The outside diameters of plateaus 26 and 28 can be nominally 0.333 inch with an axial length of 0.030 and 0.035 inch, respectively. The overall length of neck 20 can be nominally 0.145 inch. The depth of groove 30 can be nominally 0.0175 inch. It will be appreciated, however, that the foregoing dimensions are exemplary and suitable for a metallic shell of a given size and rating. For electric discharge devices of a different size or rating, the dimensions of the collar can change accordingly.

The joint between the leads 12 (FIG. 1) and the glass tube 10 are formed in the usual fashion. Similarly the joint between leads 12 and shell 14 is a conventional weld.

The collar 16 is installed in an uncrimped shell 14 by inserting neck 20 inside shell 14. Thereafter, a crimping tool can encircle the shell 14 to make the annular depression 22 (FIG. 2). Alternately, in some embodiments, the shell 14 can be rolled inside of a crimping wheel to form the annular depression.

Significantly, the increased material in area 35 will permit rolling forces strong enough to cause metal deformation to fill the "V" groove 30 around the neck 20 of the collar. This action ensures the locking of parts and more importantly makes the seal needed to prevent arcing.

Figure 3:
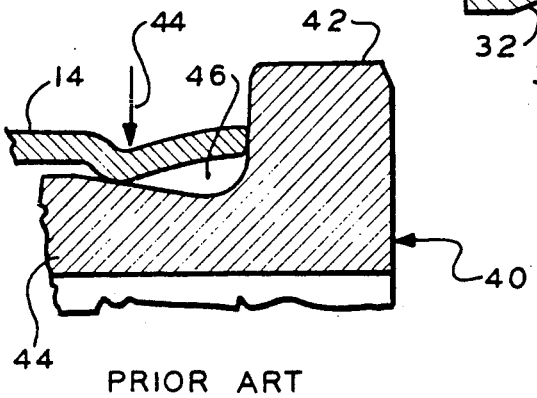
FIG. 3 is a detailed cross-sectional view of the joint between a shell and collar, according to the prior art.

In the collar of the prior art (FIG. 3) the unfilled area 46 reduced the overall compressive strength of collar 40. Thus shell 14 could not be tightly sealed onto the collar. Consequently, an arc could form between shell 14 and collar 40 to blacken the glass tube encircling the shell, especially during bombardment.

In contrast, region 35 of collar 16 (FIG. 2) is filled, making neck 20 relatively thick. Thus shell 14 can be tightly crimped and deformed to occupy and make intimate contact with groove 30. Therefore an arc does not have a clear path between shell 14 and collar 16. This path can be closed without cracking collar 16 because of its improved compressive strength.

It is to be appreciated that various modifications may be implemented with respect to the above described preferred embodiments. As noted before, the various dimensions and proportions can be altered depending upon the size of the conductive shell and the size of the non-conductive tube containing the collar. Also, the inside diameter of the collar can be altered depending upon the desired current flow though the collar. In addition, the thickness of the ceramic of the collar neck can be altered depending upon the desired strength and the expected crimping force. Also, the degree of chamfering at various corners can be altered depending upon the manufacturing restraints or the need to eliminate sharp corners that may impede assembly.

Obviously many modifications and variation of the present invention are possible in light of the above teachings. It is therefore to be understood that within the scope of the appended claims, the invention may be practiced otherwise than as specifically described.

What is claimed is:

1. In an electric discharge device having a conductive shell mounted in a nonconductive tube, a nonconductive collar for mounting in said conductive shell and comprising:

an annular neck encircled by a central annular groove located between a spaced pair of circumferential plateaus radially dimensioned to fit in said conductive shell; and an annular flange coaxially affixed to and radially larger than said annular neck.

2. A nonconductive collar according to claim 1 wherein the axial length of said groove is greater than that of either of said circumferential plateaus.

3. A nonconductive collar according to claim 2 wherein the outside of the joint between said flange and said neck is rounded.

4. A nonconductive collar according to claim 3 wherein said groove comprises two banks that are contiguous, symmetrical and frustro-conical.

5. A nonconductive collar according to claim 4 wherein the depth of said groove is less than 10% of the outside diameter of either one of said plateaus.

6. A nonconductive collar according to claim 5 wherein the outside corner of said flange distal from said neck is chamfered.

7. A nonconductive collar according to claim 6 wherein the outside diameter of said flange is at least one third greater than that of either of said plateaus.

8. An electrode for use in an electric discharge device comprising:

a conductive shell; and a nonconductive collar mounted in said conductive shell and comprising:

(a) an annular neck encircled by a central annular groove located between a spaced pair of circumferential plateaus radially dimensioned to fit in said conductive shell; and (b) an annular flange coaxially affixed to and radially longer than said annular neck.

9. An electrode according to claim 8 wherein said conductive shell has an output end with an annular depression crimped into said groove in said neck, said output end terminating in a flared section.

10. An electrode according to claim 9 wherein said flared section diverges away from and is spaced from said neck, and wherein said conductive shell is closed, supported and electrically terminated at the end distal from said collar.

11. An electrode according to claim 10 wherein the axial length of said groove in said nonconductive collar is greater than that of either of said circumferential plateaus.

12. An electrode according to claim 11 wherein the outside of the joint between said flange and said neck is rounded, and wherein said groove comprises two banks that are contiguous, symmetrical and frustro-conical.

13. An electrode according to claim 12 wherein the depth of said groove is less than 10% of the outside diameter of either one of said plateaus.

14. An electrode according to claim 13 wherein the outside corner of said flange distal from said neck is chamfered, and wherein the outside diameter of said flange is at least one third greater than that of either of said plateaus.

* * * * *